US009387672B2

(12) United States Patent
Yamagata

(10) Patent No.: US 9,387,672 B2
(45) Date of Patent: Jul. 12, 2016

(54) LIQUID EJECTING APPARATUS AND METHOD OF CONTROLLING LIQUID EJECTING APPARATUS

(71) Applicant: Seiko Epson Corporation, Shinjuku-ku (JP)

(72) Inventor: Toshiyuki Yamagata, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/603,230

(22) Filed: Jan. 22, 2015

(65) Prior Publication Data

US 2015/0210073 A1 Jul. 30, 2015

(30) Foreign Application Priority Data

Jan. 28, 2014 (JP) ..... 2014-012994

(51) Int. Cl.
*B41J 29/38* (2006.01)
*B41J 2/045* (2006.01)

(52) U.S. Cl.
CPC ..... *B41J 2/04588* (2013.01); *B41J 2/04573* (2013.01); *B41J 2/04581* (2013.01); *B41J 2/04596* (2013.01)

(58) Field of Classification Search
CPC . B41J 2/04581; B41J 2/04588; B41J 2/04541
USPC ..... 347/10
See application file for complete search history.

(56) References Cited

U.S. PATENT DOCUMENTS

| | | | | |
|---|---|---|---|---|
| 6,257,689 | B1 | 7/2001 | Yonekubo | |
| 7,520,579 | B2 * | 4/2009 | Yoshida | 347/10 |
| 2003/0016257 | A1 * | 1/2003 | Asauchi et al. | 347/10 |
| 2003/0020772 | A1 * | 1/2003 | Morikawa | B41J 2/0458 347/10 |
| 2003/0085936 | A1 * | 5/2003 | Tanaka | B41J 2/04573 347/11 |
| 2007/0008356 | A1 | 1/2007 | Katoh | |
| 2014/0253620 | A1 | 9/2014 | Watanabe et al. | |
| 2015/0210073 | A1 | 7/2015 | Yamagata | |

FOREIGN PATENT DOCUMENTS

| | | | |
|---|---|---|---|
| JP | 2008-280469 | A | 10/2000 |
| JP | 2004-330514 | A | 11/2004 |

OTHER PUBLICATIONS

Notice of Allowance in related U.S. Appl. No. 14/586,738 dated Nov. 12, 2015, 11 pages.

* cited by examiner

*Primary Examiner* — Julian Huffman
*Assistant Examiner* — Sharon A Polk
(74) *Attorney, Agent, or Firm* — Kilpatrick Townsend & Stockton LLP

(57) ABSTRACT

A liquid ejecting apparatus has a configuration in which a drive pulse is selectable from a first ejection drive pulse adjusted to be generated at a first ejection timing with respect to an LAT signal, a second ejection drive pulse adjusted to be generated at a second ejection timing which is earlier than the first ejection timing with respect to the LAT signal, and a third ejection drive pulse adjusted to be generated at a third ejection timing which is later than the first ejection timing with respect to the LAT signal, and is selected according to a transporting speed of a recording medium.

6 Claims, 8 Drawing Sheets

LIQUID EJECTING APPARATUS AND METHOD OF CONTROLLING LIQUID EJECTING APPARATUS

This application claims priority to Japanese Patent Application No. 2014-012994, filed Jan. 28, 2014, the entirety of which is incorporated by reference herein.

BACKGROUND

1. Technical Field

The present invention relates to a liquid ejecting apparatus such as an ink jet-type recording apparatus and a method of controlling the liquid ejecting apparatus, and particularly to a liquid ejecting apparatus that includes a liquid ejecting head which has a nozzle group arranged with a length corresponding to the maximum width of a landing target of a liquid and ejects the liquid from a nozzle of the liquid ejecting head while transporting the landing target and to a method of controlling the liquid ejecting apparatus.

2. Related Art

A liquid ejecting apparatus includes a liquid ejecting head and ejects (discharges) various liquids from the liquid ejecting head. An example of the liquid ejecting apparatus includes an image recording apparatus such as an ink jet-type printer or an ink jet-type plotter. Recently, the liquid ejecting apparatus has been applied to various manufacturing apparatuses due to its characteristics of being capable of causing a very small amount of liquid to land to a predetermined position with accuracy. For example, the liquid ejecting apparatus is applied to a display manufacturing apparatus that manufactures a color filter such as a liquid crystal display, an electrode producing apparatus that produces an electrode, such as an organic electro luminescence (EL) display or a surface-emitting display (FED), and a chip manufacturing apparatus that manufactures a bio chip (biochemical component). A recording head for the image recording apparatus ejects liquid-phase ink, and a color-material ejecting head for the display manufacturing apparatus ejects solutions of respective color materials which are red (R), green (G), and blue (G). In addition, an electrode-material ejecting head for the electrode producing apparatus ejects a liquid-phase electrode material and a bio-organic material ejecting head for the chip manufacturing apparatus ejects a solution of bio-organic material.

The liquid ejecting apparatus has various configurations, and yet another configuration has been proposed, in which a liquid ejecting head (line-type liquid ejecting head), of which a full length of nozzles (nozzle rows) that are arranged in a plurality of rows is set to be capable of corresponding to the maximum width of a liquid landing target such as a recording medium, is provided such that the liquid ejecting head does not move over the landing target when ejecting a liquid. According to this configuration, since there is no need to cause the liquid ejecting head to move in the main scanning direction and a landing pattern such as an image can be formed simply by transporting the landing target in the sub scanning direction, it is possible to shorten a processing time compared to a configuration of using a so-called serial head which performs the liquid ejection while the liquid ejecting head performs scanning (for example, see JP-A-2000-280469).

The liquid ejecting head mounted on the liquid ejecting apparatus includes, for example, a piezoelectric element, a heating element, or an electrostatic actuator as a pressure generating unit that causes a pressure change to occur in a liquid inside a pressure chamber which communicates with a nozzle from which the liquid is ejected and ejects the liquid from the nozzle. In the liquid ejecting apparatus, a drive waveform (drive pulse) generated by a drive signal generator is applied to the pressure generating unit and thereby the pressure generating unit is driven, which causes the liquid to be ejected. In a configuration in which a landing pattern is formed on the landing target simply by transporting the landing target in the sub scanning direction with no movement of the liquid ejecting head over the landing target of the liquid, the liquid ejecting apparatus causes the drive waveform to be generated at a timing based on position information generated in accordance with the transporting of the landing target so as to cause the liquid to land at an aimed position on the landing target with high accuracy.

Incidentally, in the liquid ejecting apparatus described above, there is a concern that behavior of a meniscus in a nozzle may be disturbed due to residual vibration after ejection of the liquid, which affects the subsequent ejection operation of the liquid. Therefore, in a normal design of the liquid ejecting apparatus, a generation timing of the drive waveform (that is, ejection timing of the liquid) and a transporting speed of the landing target are adjusted such that the effect of the residual vibration is as little as possible. In some cases, a user of the liquid ejecting apparatus (particularly, liquid ejecting apparatus for business use) causes the ejection to be performed at a timing which is not an optimal timing described above by increasing a transporting speed of the landing target in order to further increase a liquid ejection processing speed or the like, depending on a purpose. Thus, according to the timing, the ejection of the liquid becomes unstable due to the residual vibration as described above in some cases.

SUMMARY

An advantage of some aspects of the invention is to provide a liquid ejecting apparatus that suppresses an effect of residual vibration and thus, has uniform ejection characteristics of a liquid and a method of controlling the liquid ejecting apparatus.

According to an aspect of the invention, there is provided a liquid ejecting apparatus that includes a liquid ejecting head which ejects a liquid from a nozzle by applying a drive waveform to a pressure generating unit and driving the pressure generating unit and that executes a liquid ejection process of ejecting the liquid on a landing target from the nozzle of the liquid ejecting head while causing the landing target of the liquid to be transported. A plurality of drive waveforms, each of which has a different timing at which to eject the liquid with respect to a reference signal that regulates a cycle of liquid ejection, is selectively applied to the pressure generating unit according to a transporting speed of the landing target.

In this apparatus, it is desired to employ a configuration in which a drive waveform is selectable from a first drive waveform adjusted to be generated at a first ejection timing with respect to the reference signal, a second drive waveform adjusted to be generated at a second ejection timing which is earlier than the first ejection timing with respect to the reference signal, and a third drive waveform adjusted to be generated at a third ejection timing which is later than the first ejection timing with respect to the reference signal.

In this case, the plurality of drive waveforms, each of which has a different timing at which to eject the liquid with respect to the reference signal that regulates the cycle of the liquid ejection, is selectively applied to the pressure generating unit according to the transporting speed of the landing target, and thereby ejection of the liquid at a timing at which the ejection of the liquid is unstable is prevented from being performed. Thus, a significant change in the ejection characteristics such as a flying speed or amount (weight or volume) of the liquid that is ejected due to the residual vibration after the ejection is suppressed even in a case where the transporting speed of the landing target is different from a speed set in a normal design. Accordingly, it is possible to suppress an occurrence of failure such as a shift of a landing position of the liquid on the landing target.

In this apparatus, it is desired to employ a configuration in which the second drive waveform is set such that the flying speed of the liquid which is ejected is decreased compared to the case of the first drive waveform, and the third drive waveform is set such that a flying speed of the liquid which is ejected is increased compared to the case of the first drive waveform.

In this case, the second drive waveform is set such that the flying speed of the liquid which is ejected is decreased compared to the case of the first drive waveform, and the third drive waveform is set such that the flying speed of the liquid which is ejected is increased compared to the case of the first drive waveform. Thus, even when the liquids are ejected at different timings, in order to avoid a timing at which the ejection of the liquid is unstable, it is possible to suppress the shift of the landing position of a liquid on the landing target.

In this apparatus, it is desired to employ a configuration in which an ejection timing with respect to the reference signal during the current ejection is different from an ejection timing with respect to the reference signal during the previous ejection.

In this apparatus, it is desired to employ a configuration in which, in a case of selecting either the second drive waveform or the third drive waveform, a drive waveform other than a previously selected waveform is selected from these drive waveforms.

In this case, the same drive waveform is not selected consecutively over a plurality of cycles and thus, the ejection is prevented from being unstable.

In this apparatus, it is desired to employ a configuration in which the reference signal is generated according to transporting of the landing target.

In this apparatus, it is desired to employ a configuration in which the liquid ejecting head includes a first nozzle group made up of a plurality of nozzles and a second nozzle group adjacent to the first nozzle group in a transport direction of the landing target, and a liquid ejecting timing of the second nozzle group is set to be different from a liquid ejecting timing of the first nozzle group.

In this case, the liquids are not ejected at the same time from the nozzle groups adjacent in the transport direction, and thus it is possible to reduce an effect (so-called crosstalk) on the ejection characteristics due to vibration which is generated during liquid ejection.

According to another aspect of the invention, there is provided a method of controlling a liquid ejecting apparatus that includes a liquid ejecting head which ejects a liquid from a nozzle by applying a drive waveform to a pressure generating unit and driving the pressure generating unit and that executes a liquid ejection process of ejecting the liquid on a landing target from the nozzle of the liquid ejecting head while causing the landing target of the liquid to be transported. The method includes: applying selectively a plurality of drive waveforms, each of which has a different timing at which to eject the liquid with respect to a reference signal that regulates a cycle of liquid ejection, to the pressure generating unit according to a transporting speed of the landing target.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments according to the invention are described with reference to the accompanying drawings. According to an embodiment which will be described later, various limitations thereto are provided as appropriate and specific examples of the invention; however, as long as there is no indication in the following description that the invention is particularly limited, the range of the invention is not limited to these aspects. In addition, hereinafter, an ink jet-type recording apparatus (hereinafter, printer) is described as an example of a liquid ejecting apparatus according to the invention.

Figure 1:
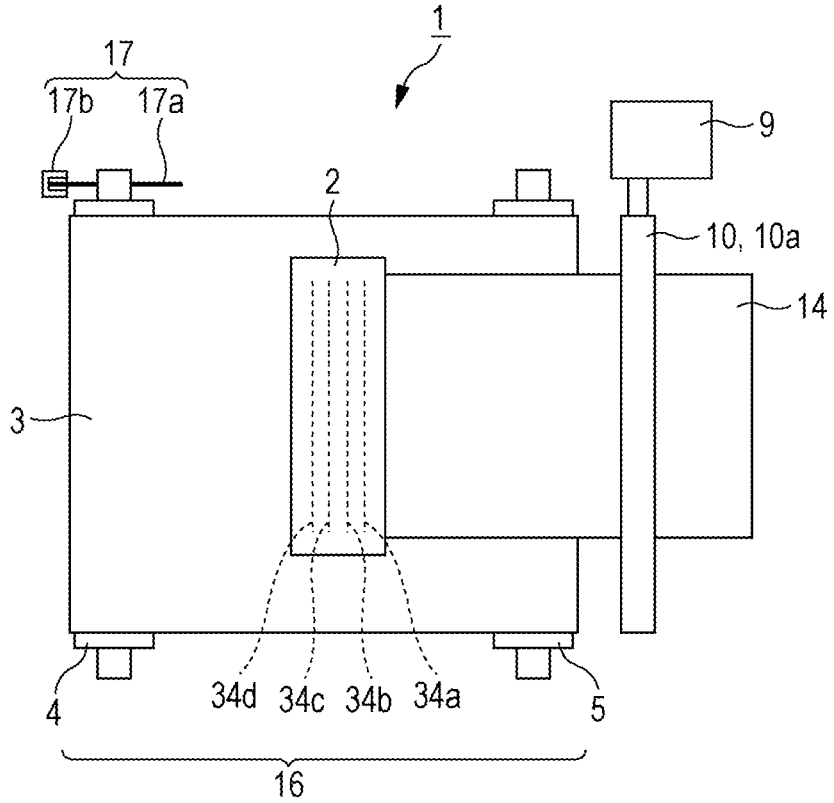
FIG. 1 is a plan view illustrating an internal configuration of a printer.
Figure 2:
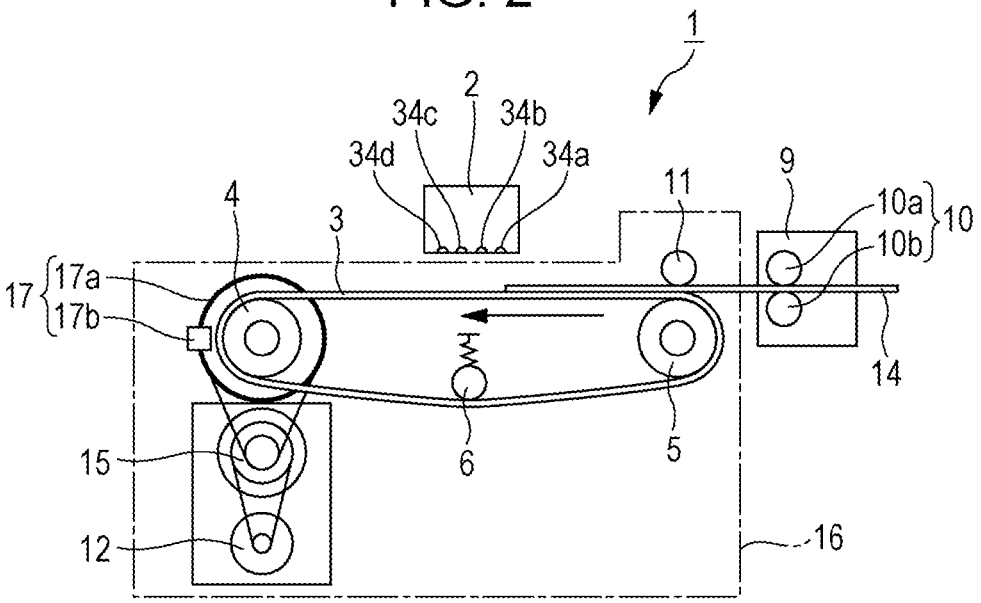
FIG. 2 is a side view illustrating the internal configuration of the printer.

FIG. 1 is a plan view illustrating a configuration of a printer 1 and FIG. 2 is a side view illustrating an example of the configuration of the printer 1. The printer 1 is a so-called line head ink jet recording apparatus that sequentially transports recording sheets 14 such as roll paper (a kind of recording medium or landing target), ejects ink that is a kind of liquid to the recording sheet 14 from a recording head 2, and forms a landing pattern such as an image or text on the recording sheet 14. According to the present embodiment, the printer 1 is schematically configured to include the recording head 2, feed rollers 10 that supply the recording sheet 14 to a transport belt 3, a feed motor 9 that drives the feed rollers 10, a transport mechanism 16 that transports the recording sheet 14 by using the transport belt 3, and an encoder 17 (rotary encoder) that detects a transport amount of the recording sheet 14 by the transport mechanism 16.

The feed rollers 10 are disposed on the upstream side of the transport mechanism 16 and are configured to have a pair of upper and lower rollers 10*a* and 10*b* which are capable of synchronous rotation in opposite directions to each other in a state of pinching the recording sheet 14 fed from a feeding unit not illustrated. The feed rollers 10 are driven by power from the feed motor 9 and are configured to supply the recording sheet 14 to the transport mechanism 16 side. The transport mechanism 16 is configured to include a transport motor 12 that is a power source of the transport belt 3, a drive roller 4, a deceleration mechanism 15 that reduces a rotational speed of the transport motor 12 and transmits power of the transport motor 12 to the drive roller 4, a driven roller 5 that is disposed on the upstream side from the drive roller 4, the endless transport belt 3 stretched between the drive roller 4 and the driven roller 5, a tension roller 6 that imparts tension to the transport belt 3, and a pressure roller 11 that presses the recording sheet 14 to the transport belt 3 side. The tension roller 6 is disposed between the drive roller 4 and the driven roller 5, is inscribed in the transport belt 3, and imparts tension to the transport belt 3 by a bias force of a bias member such as a spring. In addition, the pressure roller 11 is disposed directly above the driven roller 5 such that the transport belt 3 is pinched therebetween and provided to be in contact with the transport belt 3.

The encoder 17 (transporting speed detecting unit) which is configured to have an encoder scale 17*a* and a detection head 17*b* is provided on the rotating shaft of the drive roller 4. The encoder scale 17*a* has a plurality of slits (stripes) over the entire circumference of a disk-like plate at equal intervals along the outer circumferential edge of the disk. In the encoder scale 17*a*, slits that transmit light may be formed on a plate through which light is not transmitted or slits through which light is not transmitted may be formed on a plate that transmits light. In addition, the detection head 17*b* optically detects the slits moving in accordance with the rotation of the drive roller 4. The detection head 17*b* is configured to include a pair of a light-emitting element and a light-receiving element disposed to face each other (neither illustrated) and to output the encoder pulse EP according to a difference between a light-receiving state on a slit portion and a light-receiving state on another portion apart from the slit portion of the encoder scale 17*a* which passes between the light-emitting element and the light-receiving element. The encoder pulse EP is output to the controller 44 (refer to FIG. 4) of the printer 1. Accordingly, the controller 44 can store information of a transport amount and a transporting speed of the recording sheet 14 by the transport mechanism 16 on the basis of the encoder pulse EP. In addition, the encoder pulse EP regulates a generation timing of a drive signal (drive waveform) for driving the piezoelectric element 23 which is a pressure generating unit of the recording head 2. The encoder 17 is not limited to the illustrated examples, and may be realized in any aspect as long as the encoder 17 can detect the transport amount (transporting speed) of the recording sheet 14.

Figure 3:
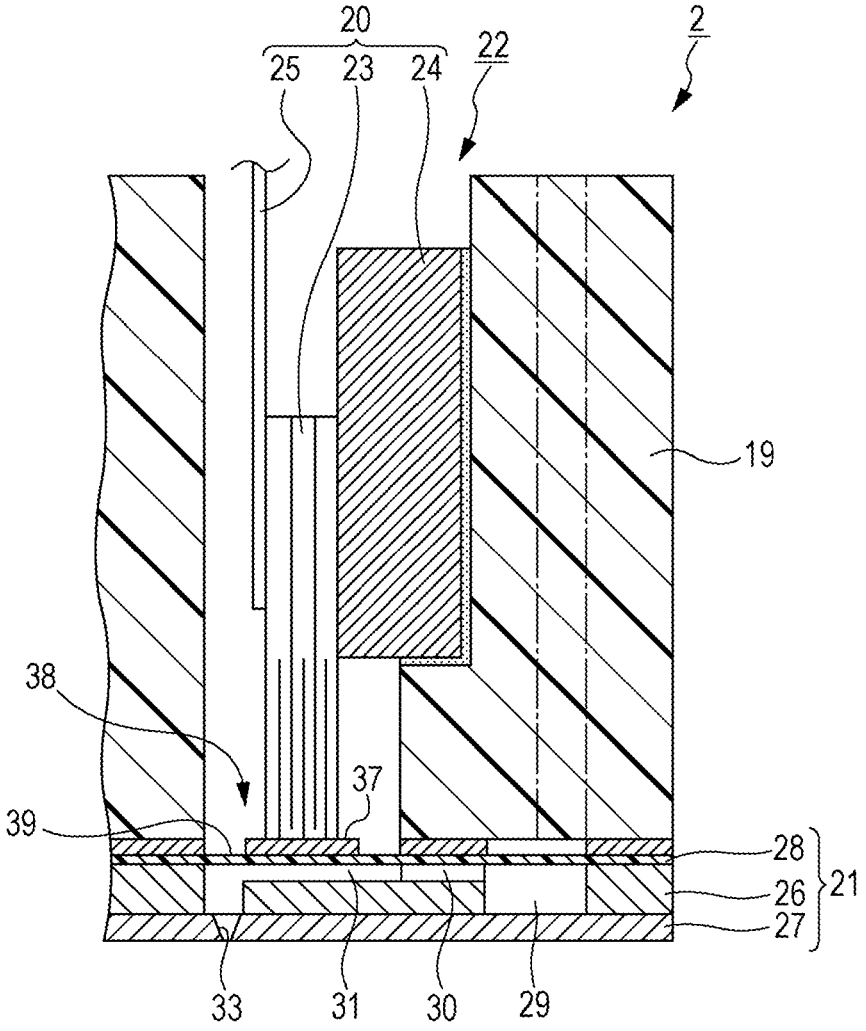
FIG. 3 is a cross-sectional view of main components illustrating a configuration of a recording head.

FIG. 3 is a cross-sectional view of main components illustrating a configuration of the recording head 2. The recording head 2 includes a case 19, a vibrator unit 20 that is accommodated in the case 19, and a flow path unit 21 that is joined to a bottom surface (tip end surface) of the case 19. The case 19 is, for example, made of an epoxy resin and an accommodation space section 22 for accommodating the vibrator unit 20 is formed therein. The vibrator unit 20 includes a piezoelectric element 23 that functions as a kind of pressure generating unit, a fixation plate 24 to which the piezoelectric element 23 is joined, and a flexible cable 25 for supplying the drive signal or the like to the piezoelectric element 23. The piezoelectric element 23 is formed as a laminated type manufactured by cutting a piezoelectric plate, in which a piezoelectric layer and an electrode layer are laminated alternately, into a comb-teeth shape and is a piezoelectric element having a longitudinal vibration mode in which the piezoelectric element can expand and contract (electric field transverse effect type) in a direction orthogonal to a lamination direction (electric field direction).

The flow path unit 21 is configured by joining a nozzle plate 27 to one surface of a flow path formation substrate 26 and a vibration plate 28 to the other surface of the flow path formation substrate 26. A reservoir 29 (common liquid chamber), an ink supplying port 30, a pressure chamber 31, and a nozzle 33 are provided in the flow path unit 21. A series of ink flow paths from the ink supplying port 30 through the pressure chamber 31 to the nozzle 33 is formed corresponding to each nozzle 33.

The nozzle plate 27 described above is a thin plate made of metal such as stainless steel in which a plurality of nozzles 33 is bored in rows at a pitch corresponding to a dot forming density. A plurality of nozzle rows 34 (nozzle group), each of which has the plurality of nozzles 33 arranged in a direction orthogonal to the transport direction of the recording sheet 14, is provided side by side in the transport direction in the nozzle plate 27. According to the present embodiment, as illustrated in FIG. 1, the recording head 2 includes a total of four nozzle rows 34 of a first nozzle row 34*a*, a second nozzle row 34*b*, a third nozzle row 34*c*, and a fourth nozzle row 34*d* from the upstream side to the downstream side in the transport direction. Each of these nozzle rows 34*a* to 34*d* is configured to include a plurality of nozzles 33 arranged with a length greater than the maximum width of the recording sheet 14. In the recording head 2, a nozzle plane, on which these nozzles 33 (nozzle rows 34) are formed, is disposed toward the recording sheet 14 and a slight gap is formed between the nozzle plane and the recording sheet 14.

The vibration plate 28 is a composite plate material in which a resin film as an elastic body film is laminated on the front surface of a metal support plate. A diaphragm section 38 that changes the volume of the pressure chamber 31 is provided on the vibration plate 28. The diaphragm section 38 is manufactured by partially removing the support plate by using an etching process or the like. That is, the diaphragm section 38 is formed to have an insular section 37 to which a tip end surface of a free end section of the piezoelectric element 23 is joined and a thin elastic section 39 that surrounds the insular section 37. Since the tip end surface of the piezoelectric element 23 is joined to the insular section 37 described above, the free end section of the piezoelectric element 23 expands and contracts and, thereby, it is possible to change the volume of the pressure chamber 31. A pressure change in the ink inside the pressure chamber 31 occurs due to the volume change. The recording head 2 utilizes the pressure change and ejects the ink from the nozzle 33.

Figure 4:
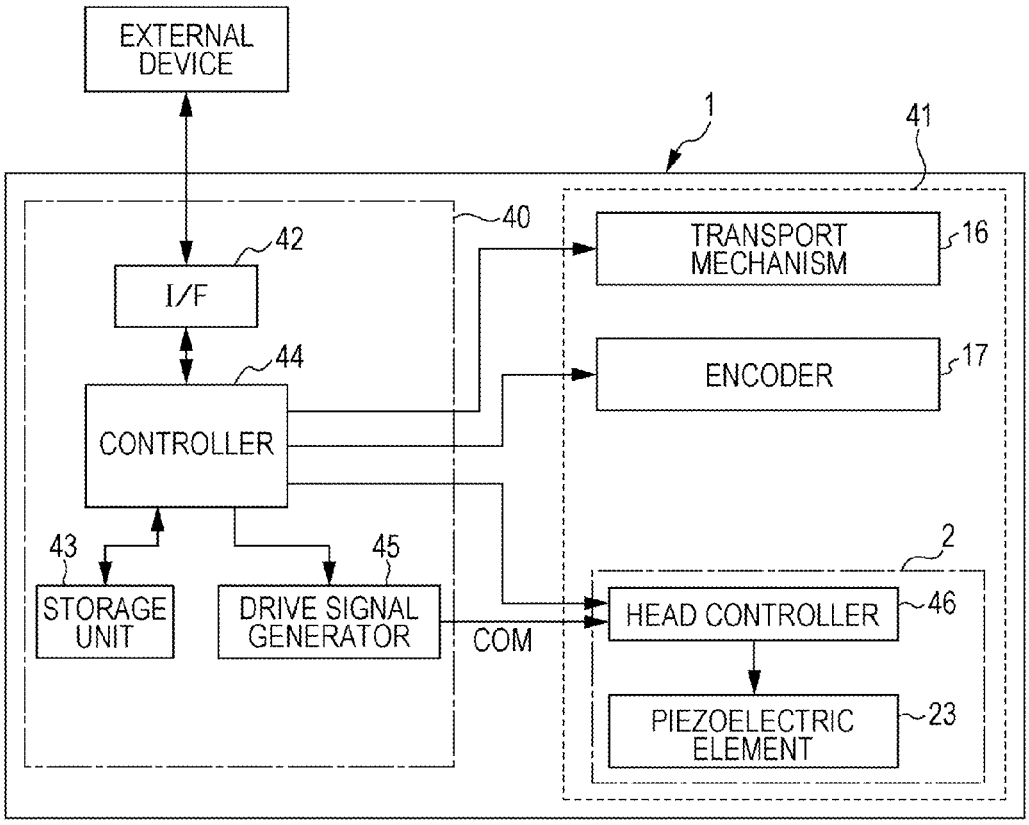
FIG. 4 is a block diagram illustrating an electrical configuration of the printer.

FIG. 4 is a block diagram illustrating an electrical configuration of the printer 1. The printer 1 according to the present embodiment includes a print engine 41 including the transport mechanism 16, the encoder 17, the recording head 2, or the like, and the printer controller 40.

The printer controller 40 is a control unit that performs control of each component of the printer. The printer controller 40 according to the present embodiment includes an external interface (I/F) unit 42, a controller 44, a storage unit 43, and a drive signal generator 45. The external interface unit 42 performs transmission and reception of status data of the printer when the print data or a printing command is transmitted from the external device to the printer 1 or status information of the printer 1 is output to the external device side. The controller 44 is a computation processing system for performing control of the entire printer. The storage unit 43 is an element that stores data which is used for a program or various types of control of the controller 44 and includes a ROM, a RAM, and a nonvolatile random access memory (NVRAM). The controller 44 controls each unit according to the program stored in the storage unit 43. In addition, the controller 44 according to the present embodiment generates ejection data representing at which timing and from which nozzle 33 of which nozzle row 34 the ink is ejected during the recording operation based on the print data from the external device and transmits the ejection data to a head controller 46 of the recording head 2. The drive signal generator 45 (drive waveform generating unit) generates an analog signal on the basis of waveform data related to a waveform of a drive signal, amplifies the signal, and then generates a drive signal (drive pulse) illustrated in FIG. 5A, 5B, or 5C.

Figure 5A:
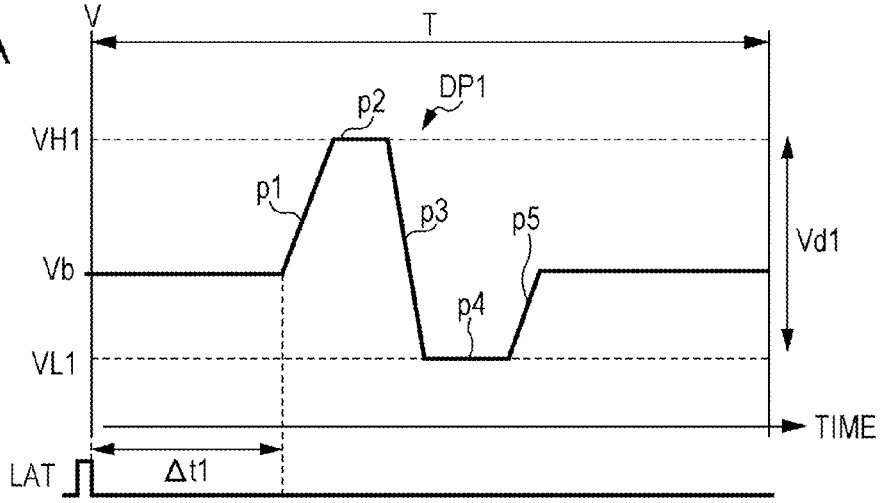
FIGS. 5A to 5C are diagrams of waveforms illustrating configurations of drive pulses.
Figure 5B:
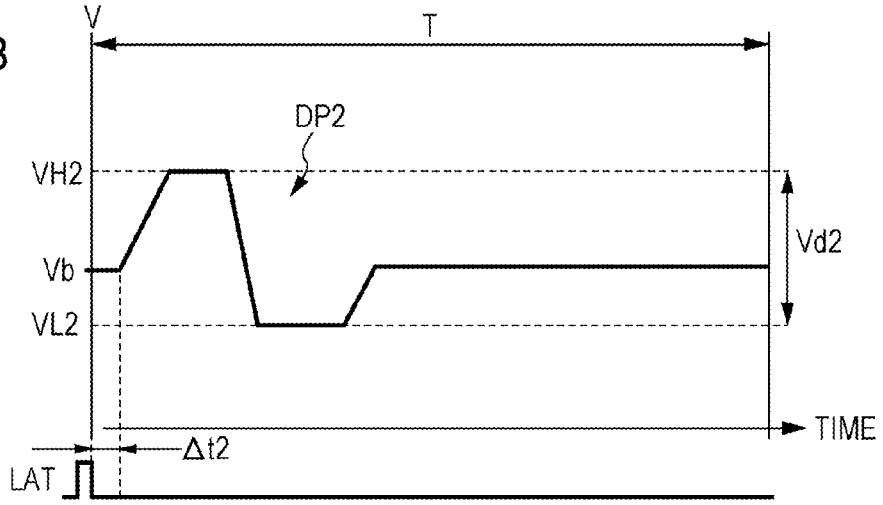
Figure 5C:
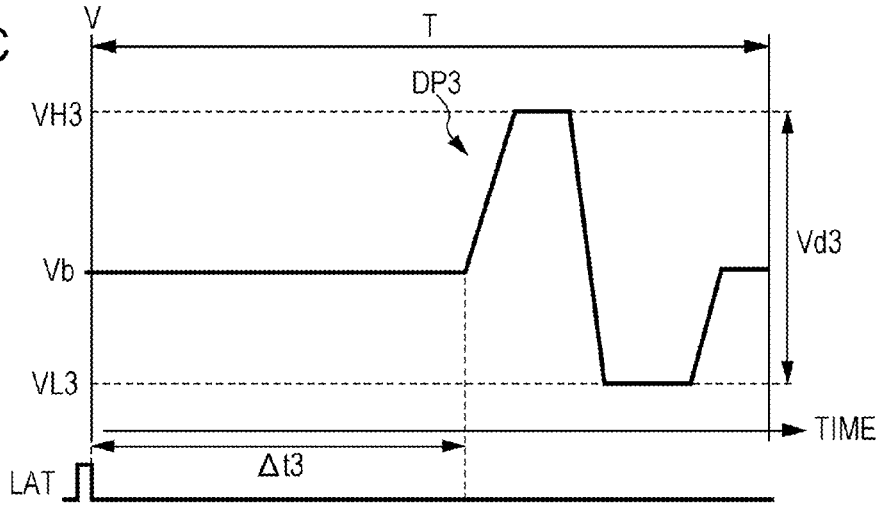

FIGS. 5A to 5C are diagrams of waveforms illustrating examples of configurations of drive pulses which are generated by the drive signal generator 45. The drive pulses are generated repeatedly by the drive signal generator 45 for each unit cycle T which is regulated by a latch signal LAT that is generated in accordance with the encoder pulse EP described above. The unit cycle T corresponds to one pixel of an image or the like which is printed on the recording sheet 14. According to the present embodiment, three types of ejection drive pulses DP1 to DP3 are generated, including a first ejection drive pulse DP1 (corresponding to the first drive waveform according to the invention) illustrated in FIG. 5A, a second ejection drive pulse DP2 (corresponding to the second drive waveform according to the invention) illustrated in FIG. 5B, and a third ejection drive pulse DP3 (corresponding to the third drive waveform according to the invention) illustrated in FIG. 5C. When a dot pattern corresponding to one line (one raster) is formed in the recording region on the recording sheet 14 during a printing process, one of these drive pulses DP1 to DP3 is selectively applied to the piezoelectric element 23 provided in each pressure chamber 31. Shapes of the ejection drive pulses DP1 to DP3 are not limited to the examples in the drawings, and it is possible to employ various shapes of waveform according to an amount or the like of ink that is ejected from the nozzle 33. In addition, these drive pulses DP1 to DP3 may be configured to be included in the same drive signal when the drive pulses DP1 to DP3 can be generated so as not to interfere with each other.

The ejection drive pulses DP1 to DP3 are all drive pulses (corresponding to drive waveforms according to the invention) which are generated so as to cause ejection of the ink from the nozzle 33 and each ejection drive pulse includes a preliminary expansion portion p1, an expansion hold portion p2, a contraction portion p3, a contraction hold portion p4, and an expansion-returning portion p5. The preliminary expansion portion p1 is an element of the waveform which causes the piezoelectric element 23 to be displaced such that the pressure chamber 31 expands from a reference volume (initial volume) corresponding to a reference potential Vb to an expanded volume and the expansion hold portion p2 is an element of the waveform which causes the expanded volume of the pressure chamber 31 to be maintained. In addition, the contraction portion p3 is an element of the waveform which causes the piezoelectric element 23 to be displaced such that the pressure chamber 31 contracts from the expanded volume to a contracted volume which is less than the reference volume and ejects the ink from the nozzle 33 and the contraction hold portion p4 is an element of the waveform which causes the contracted volume of the pressure chamber 31 to be maintained. The expansion-returning portion p5 is an element of the waveform which causes the piezoelectric element 23 to be displaced such that the pressure chamber 31 returns to the reference volume from the contracted volume.

Here, in a normal design of the printer 1, a generation timing of the drive pulse (that is, ejection timing of the liquid) and a transporting speed of the recording sheet 14 are adjusted such that the effect of the residual vibration is as little as possible when the ink is ejected continuously from the same nozzle 33. Incidentally, in some cases, a user may cause the printing to be performed at a setting which is different from the normal design by increasing the transporting speed for increasing a printing process speed to be higher or the like. According to the present embodiment, the drive signal generator 45 is configured to output a drive signal (drive pulse) depending on a condition of receiving a latch signal LAT based on the encoder pulse EP that is output according to transporting of the recording sheet 14. Thus, according to the timing, the ejection of the ink becomes unstable due to the residual vibration as described above in some cases. Specifically, for example, in the case of the timing at which, compared to the residual vibration after ejection of ink in a certain cycle, pressure vibration which is produced when the ink is ejected in the next cycle is extremely strong or extremely weak, a flying speed, a flying direction, and an amount of ink ejected from the nozzle 33 may change from a target value. As a result, a streak, color unevenness, or the like may be produced on the image or the like recorded on the recording sheet 14 and image quality may be lowered. Taking into account such problems, in the printer 1 according to the invention, the ejection drive pulses DP1 to DP3 described above are selectively applied to the piezoelectric element 23 according to the transporting speed of the recording sheet 14 and, thereby, the occurrence of the failure described above is decreased, which will be described as follows, hereinafter.

The first ejection drive pulse DP1 illustrated in FIG. 5A is a drive pulse of which parameters such as a voltage or elements of the waveform are optimized in a case where the printing process is performed at the transporting speed (hereinafter, appropriately referred to as a reference transporting speed) which is set in the normal design. A time from an LAT signal to the beginning of the first ejection drive pulse DP1 (beginning of the preliminary expansion portion p1) is set to Δt1. When the ink is continuously ejected at and the transporting speed is set to the reference transporting speed, Δt1 is set to be an ejection timing at which a flying speed or an amount of the ink that is ejected is stable with no significant change from a designed target value. A timing at which the ink is ejected by the first ejection drive pulse DP1 that is generated after Δt1 from the LAT signal is a first ejection timing according to the invention. The second ejection drive pulse DP2 illustrated in FIG. 5B is a drive pulse that is generated at a timing which is earlier than the timing of the first ejection drive pulse DP1 in the unit cycle T. A time Δt2 from the LAT signal to the beginning of the second ejection drive pulse DP2 is set to a value of a time that is shorter than Δt1. A timing at which the ink is ejected by the second ejection drive pulse DP2 that is generated after Δt2 from the LAT signal is a second ejection timing according to the invention. Similarly, the third ejection drive pulse DP3 illustrated in FIG. 5C is a drive pulse that is generated at a timing which is later than the timing of the first ejection drive pulse DP1 in the unit cycle T. Time Δt3 from the LAT signal to the beginning of the third ejection drive pulse DP3 is set to a value of a time that is longer than Δt1. A timing at which the ink is ejected by the third ejection drive pulse DP3 that is generated after Δt3 from the LAT signal is a third ejection timing according to the invention.

These ejection drive pulses DP1 to DP3 are set to have different voltages from each other (potential difference from the lowest potential to the highest potential). Specifically, a voltage Vd2 of the second ejection drive pulse DP2 is set to be lower than a voltage Vd1 of the first ejection drive pulse DP1. In addition, a voltage Vd3 of the third ejection drive pulse DP3 is set to be higher than the voltage Vd1 of the first ejection drive pulse DP1. That is, these ejection drive pulses DP1 to DP3 have a relationship of Vd2<Vd1<Vd3. The higher the voltage of the ejection drive pulse, the more a flying speed Vm of the ink which is ejected from the nozzle 33 is increased. The lower the voltage of the ejection drive pulse, the more the flying speed Vm of the ink which is ejected from the nozzle 33 is decreased. Accordingly, the second ejection drive pulse DP2 is a drive waveform in which the flying speed of the ink which is ejected from the nozzle 33 is set to be lower than that in the case of the first ejection drive pulse DP1. The third ejection drive pulse DP3 is a drive waveform in which the flying speed of the ink which is ejected from the nozzle 33 is set to be higher than that in the case of the first ejection drive pulse DP1.

Figure 6:
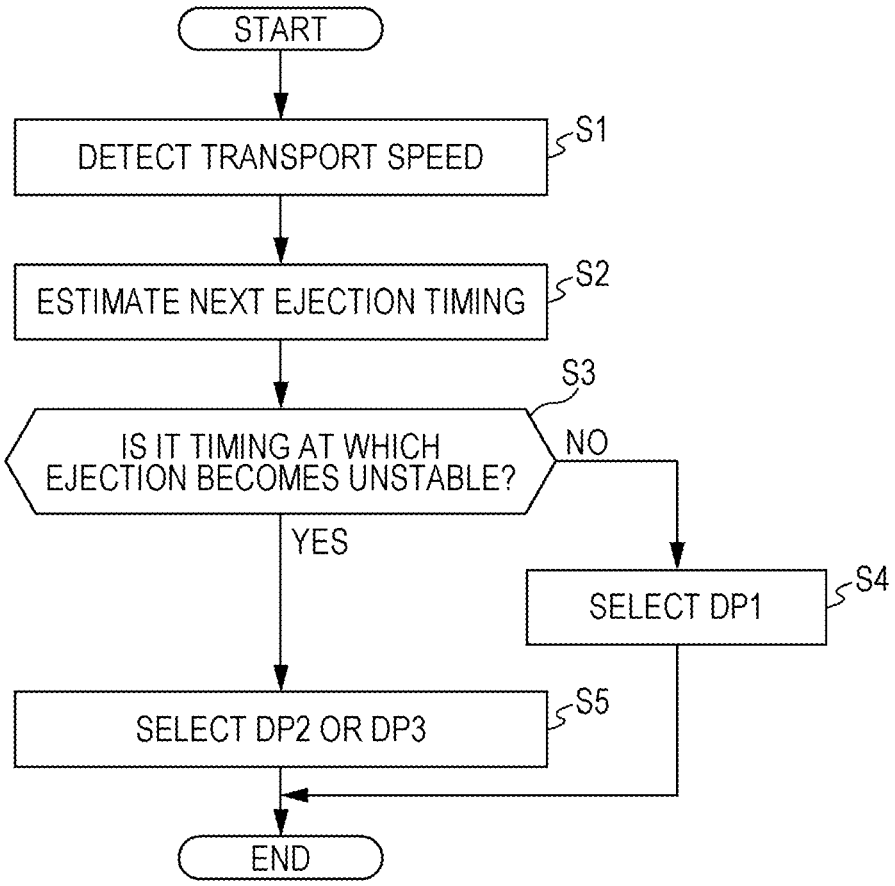
FIG. 6 is a flowchart illustrating selection control of a drive pulse in a recording process.
Figure 7A:
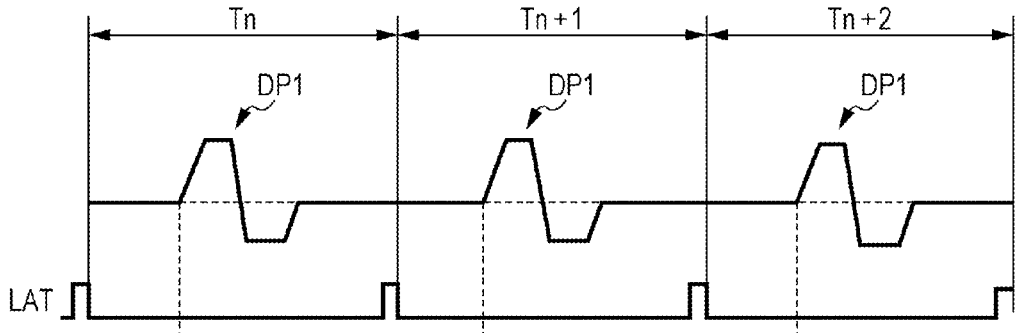
FIGS. 7A and 7B are timing charts illustrating selection examples of the drive pulses.
Figure 7B:
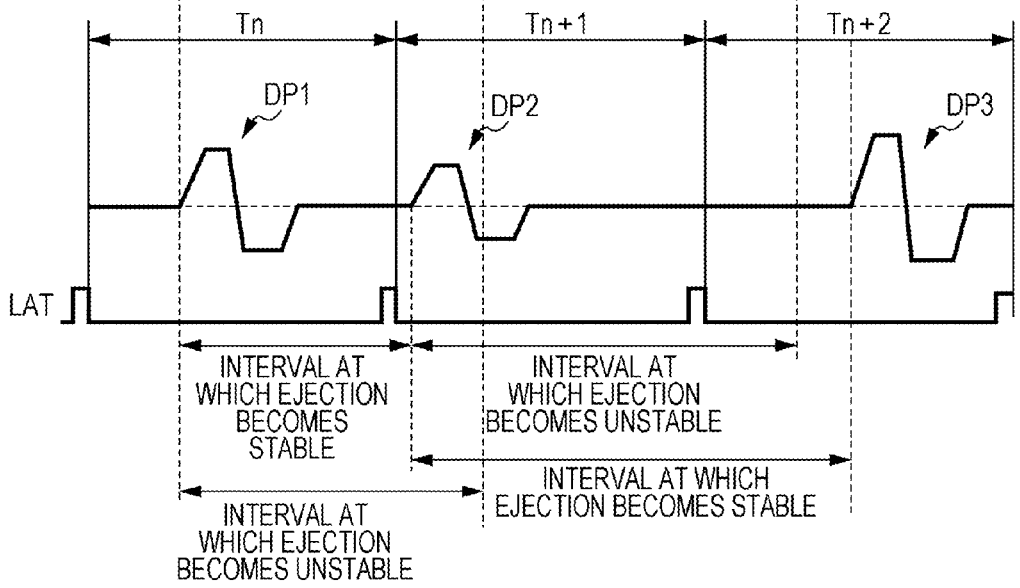

FIG. 6 is a flowchart illustrating selection control of a drive pulse in the recording process (printing process). In addition, FIGS. 7A and 7B are timing charts illustrating selection examples of the drive pulses. Here, FIG. 7A illustrates a selection pattern of drive pulses when the ejection does not become unstable in a case where the first ejection drive pulse DP1 is used in consecutive cycles Tn, Tn+1, and Tn+2 in the recording process (for example, when performing the recording process at the reference transporting speed). In addition, FIG. 7B illustrates a selection pattern when the ejection becomes unstable in a case where the first ejection drive pulse DP1 is used in the consecutive cycles Tn, Tn+1, and Tn+2 in the recording process at a transporting speed which is different from the reference transporting speed. In FIGS. 7A and 7B, the generation intervals of the LAT signals are uniform for convenience. However, in a case where the transporting speeds in FIGS. 7A and 7B are different from each other, practically the intervals of the LAT signals are also different from each other. For example, when the transporting speed is higher in FIG. 7B than in the case of FIG. 7A, the intervals of the LAT signals in FIG. 7B become narrower than those in FIG. 7A. When the transporting speed is lower in FIG. 7B than in the case of FIG. 7A, the intervals of the LAT signals in FIG. 7B become wider than those in FIG. 7A.

In a case where the recording process for an image or the like is performed while the recording sheets 14 are transported sequentially by the transport mechanism 16, the transport amount of the recording sheets 14 is detected by the encoder 17, and the encoder pulse EP which is the detection signal is transmitted to the controller 44. The controller 44 detects the transporting speed on the basis of the encoder pulse EP (step S1). In addition, the controller 44 estimates the timing at which subsequent ejection of the ink is performed based on the transporting speed (step S2). Specifically, for example, a timing is predicted, at which the LAT signal of the next cycle is generated on the basis of the transporting speed and the transport amount in one cycle and it is predicted that the next ejection timing of the ink comes after the time Δt1 from the LAT signal to the beginning of the first ejection drive pulse DP1 in the cycle.

Subsequently, the controller 44 determines whether or not the next ejection timing of the ink is a timing at which the ejection becomes unstable (step S3). That is, in terms of a relationship between a meniscus and the residual vibration produced by the ejection of the ink in the current cycle Tn, the controller 44 determines whether or not values of the characteristics of ejection are significantly different from the target values when the ink is ejected by using the first ejection drive pulse DP1 in the next cycle Tn+1. In a case where it is determined that the ejection does not become unstable when the ink is ejected by using the first ejection drive pulse DP1 in the next cycle Tn+1 (or the recording process is performed at the reference transporting speed) (No), the process proceeds to step S4. The controller 44 causes the head controller 47 to perform control of selecting the first ejection drive pulse DP1 in the next cycle Tn+1 and applying the first ejection drive pulse DP1 to the piezoelectric element 23 (FIG. 7A). Meanwhile, in a case where it is determined that the ejection becomes unstable when the ink is ejected by using the first ejection drive pulse DP1 in the next cycle Tn+1 (an interval between the first ejection drive pulse DP1 in the cycle Tn and the first ejection drive pulse DP1 in the cycle Tn+1 is an interval in which the ejection becomes unstable) (Yes), the process proceeds to step S5. The controller 44 causes the head controller 47 to perform control of selecting either the second ejection drive pulse DP2 or the third ejection drive pulse DP3 in the next cycle Tn+1 and applying the selected drive pulse to the piezoelectric element 23. In the example illustrated in FIG. 7B, the second ejection drive pulse DP2 is selected in the cycle Tn+1 and, thus, an interval between the first ejection drive pulse DP1 in the cycle Tn and the second ejection drive pulse DP2 in the cycle Tn+1 becomes an interval at which the ejection becomes stable. Accordingly, the ejection is prevented from being unstable in the cycle Tn+1. When it is possible to suppress an occurrence of the unstable ejection, the third ejection drive pulse DP3 may be selected.

Similarly, in a case where the ejection of the ink becomes unstable when the ink is ejected by using the first ejection drive pulse DP1 in the next cycle Tn+2 after the ink is ejected by using the second ejection drive pulse DP2 in the cycle Tn+1 (case where the interval between the second ejection drive pulse DP2 in the cycle Tn+1 and the first ejection drive pulse DP1 in the cycle Tn+2 is an interval in which the ejection becomes unstable), an ejection drive pulse is selected in the cycle Tn+2 so as to avoid a timing at which the ejection becomes unstable. Here, since the transporting speed of the recording sheet 14 is constant, the generation cycle of the LAT signals is also constant. Therefore, if, after the second ejection drive pulse DP2 is selected and the ink is ejected in the cycle Tn+1, the second ejection drive pulse DP2 is again selected in the next cycle Tn+2, the ejection becomes unstable. That is, if the same drive pulse is consecutively selected over a plurality of cycles, the ejection becomes unstable. Therefore, in a case where the second ejection drive pulse is selected in the cycle Tn+1, the third ejection drive pulse DP3 that is different from the second ejection drive pulse DP2 is selected in the next cycle Tn+2 and thereby it is possible to avoid a timing at which the ejection becomes unstable. That is, in a case where either the second ejection drive pulse DP2 or the third ejection drive pulse DP3 is selected, a drive pulse that is different from the drive waveform selected in the previous cycle is selected from these drive pulses. In short, the ejection timing with respect to the LAT signal during the current ejection may be different from the ejection timing with respect to the LAT signal during the previous ejection. For example, in a case where the second ejection drive pulse is selected in the cycle Tn+1, the first ejection drive pulse DP1 may be selected in the next cycle Tn+2 as long as it is possible to suppress the unstable ejection.

Figure 8:
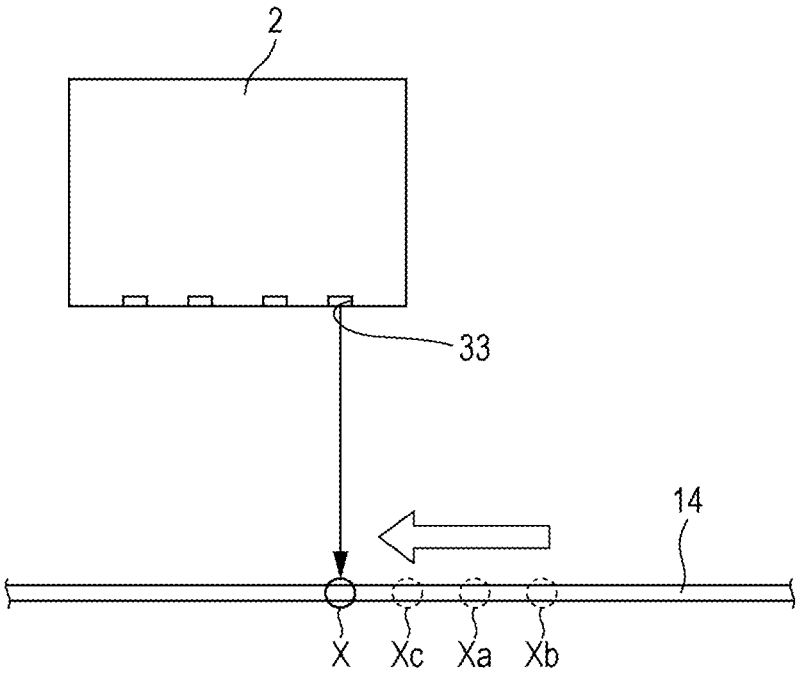
FIG. 8 is a diagram schematically illustrating ejection timings and landing positions on a recording sheet when ejection drive pulses are selected in predetermined cycles, respectively.

Here, FIG. 8 is a diagram schematically illustrating ejection timings and flying direction of the ejected ink when the ejection drive pulses DP1 to DP3 are selected in predetermined cycles, respectively. A direction represented by an arrow is the transport direction of the recording sheet 14. In addition, X represents an actual ink landing position, Xa represents a predetermined landing position at a timing at which the ink is ejected by the first ejection drive pulse DP1, Xb represents a predetermined landing position at a timing at which the ink is ejected by the second ejection drive pulse DP2, and Xc represents a predetermined landing position at a timing at which the ink is ejected by the third ejection drive pulse DP3. In FIG. 8, in a case where the first ejection drive pulse DP1 is selected, the ink is ejected from the nozzle 33 when the predetermined landing position is a position represented by Xa, flies toward the recording sheet 14, and lands when the predetermined landing position reaches the position represented by X.

In addition, in a case where the second ejection drive pulse DP2 is selected, the ink is ejected from the nozzle 33 at a timing at which the predetermined landing position reaches the position represented by Xb on the upstream side from Xa. As described above, since the second ejection drive pulse DP2 is set to have a slower flying speed of the ink than that in the case of the first ejection drive pulse DP1, flying time from the ejection of the ink to landing on the recording sheet 14 becomes longer and the distance over which the recording sheet 14 is transported until the ink lands becomes longer by an equivalent amount. Therefore, ink ejected by the second ejection drive pulse DP2 at the timing at which the predetermined landing position is Xb lands on the recording sheet 14 when the predetermined landing position almost reaches X. Similarly, in a case where the third ejection drive pulse DP3 is selected, the ink is ejected from the nozzle 33 at a timing at which the predetermined landing position reaches the position represented by Xc on the downstream side from Xa. Since the third ejection drive pulse DP3 is set to have a higher flying speed of the ink than that in the case of the first ejection drive pulse DP1, flying time from the ejection of the ink to landing on the recording sheet 14 becomes shorter and the distance over which the recording sheet 14 is transported until the ink lands becomes shorter by an equivalent amount. Therefore, ink ejected by the third ejection drive pulse DP3 at the timing, at which the predetermined landing position is Xc, lands on the recording sheet 14 when the predetermined landing position almost reaches X.

As described above, in the printer 1 according to the invention, according to the transporting speed of the recording sheet 14, the ejection drive pulses DP1 to DP3 described above are selectively applied to the piezoelectric element 23 and, thus, significant change of the ejection characteristics such as the flying speed or amount (weight or volume) of the ink that is ejected, due to the residual vibration after the ejection of the ink is suppressed even in a case where the transporting speed is different from the set speed of the normal design. Accordingly, it is possible to suppress a shift of the landing position of the ink on the recording sheet 14 or size variations of the dots. In addition, according to the present embodiment, since the second ejection drive pulse DP2 is set to have the lower flying speed of the ink that is ejected than that in the case of the first ejection drive pulse DP1 and the third ejection drive pulse DP3 is set to have the higher flying speed of the ink that is ejected than that in the case of the first ejection drive pulse DP1, it is possible to suppress the shift of the landing position on the recording sheet 14 even when the ink is ejected at a different timing so as to avoid the unstable ejection.

Figure 9A:
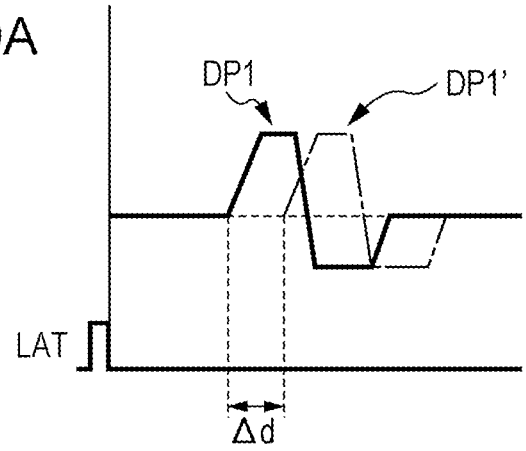
FIGS. 9A to 9C are diagrams of waveforms illustrating configurations of ejection drive pulses corresponding to odd-numbered rows and delayed drive pulses corresponding to even-numbered rows.
Figure 9B:
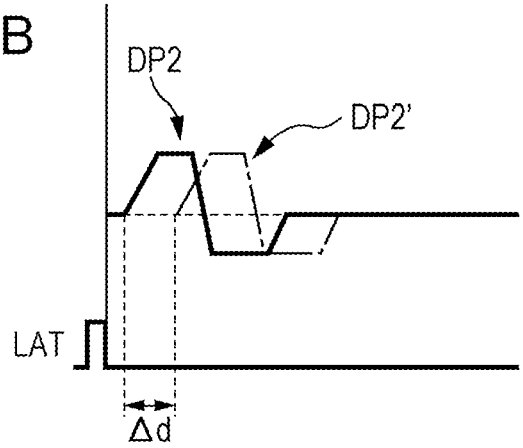
Figure 9C:
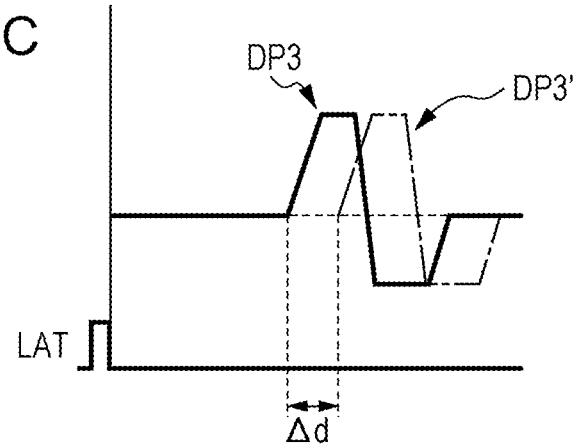

Next, in the recording head 2 including the plurality of nozzle rows 34*a* to 34*d*, suppression of crosstalk in a case where these nozzle rows 34 are simultaneously driven will be described. The recording head 2 according to the present embodiment is provided in a state in which the plurality of nozzle rows 34 are relatively close to each other and the nozzle rows 34 are configured to include many nozzles 33 compared to a case of a so-called serial printer. Therefore, when many nozzles 33 of the nozzle rows 34 are caused to be driven simultaneously, vibration (vibration due to driving of the piezoelectric element 23) is likely to be greater. In a case where ink is ejected from adjacent nozzle rows 34 simultaneously, vibration is transmitted between these nozzle rows and thus so-called crosstalk which affects the ejection characteristics of the ink is likely to be produced. Therefore, according to the present embodiment, the nozzle rows 34*a* to 34*d* which are arranged in this order from the upstream side are divided into, for example, odd-numbered rows (first nozzle row 34*a* and third nozzle row 34*c*) and even-numbered rows (second nozzle row 34*b* and fourth nozzle row 34*d*). Selection control of the ejection drive pulses DP1 to DP3 is performed in the odd-numbered nozzle rows 34*a* and 34*c* (corresponding to a first nozzle group) and selection control using delayed drive pulses DP1' to DP3' of which a timing is delayed uniformly by Δd from the ejection drive pulses DP1 to DP3 as illustrated in FIGS. 9A to 9C is performed in the even-numbered nozzle rows 34*b* and 34*d* (corresponding to a second nozzle group). As illustrated in FIG. 9A, the first delayed drive pulse DP1' is set to be the same waveform as the first ejection drive pulse DP1 and is a drive pulse that is generated by being delayed from the first ejection drive pulse DP1 by Δt. Δt is set to be a value in a range of, for example, 1 μs to 6 μs. Within the above range, it is possible to delay the ejection timing in the adjacent nozzle rows without affecting the recording process (without lengthening the process time). Similarly, the second delayed drive pulse DP2' is set to be the same waveform as the second ejection drive pulse DP2 and is a drive pulse that is generated by being delayed from the second ejection drive pulse DP2 by Δt and the third delayed drive pulse DP3' is set to be the same waveform as the third ejection drive pulse DP3 and is a drive pulse that is generated by being delayed from the third ejection drive pulse DP3 by Δt.

In the selection control of the drive pulses described above, for example, in a case where the first ejection drive pulse DP1 is selected in the odd-numbered rows, the first delayed drive pulse DP1' is selected in the even-numbered rows. Similarly, in a case where the second ejection drive pulse DP2 is selected in the odd-numbered rows, the second delayed drive pulse DP2' is selected in the even-numbered rows and in a case where the third ejection drive pulse DP3 is selected in the odd-numbered rows, the third delayed drive pulse DP3' is selected in the even-numbered rows. In this way, since ejection control is performed in a method of a time-division drive such that the ink ejection timing of the even-numbered row is different from the ink ejection timing of the odd-numbered row, it is possible to reduce effects (crosstalk) due to the vibration occurring during the ejection on the ejection characteristics without performing the ejections of the ink from adjacent nozzle rows 34 in the transport direction at the same time as each other. It is needless to say that a configuration may be employed, in which the even-numbered rows are set as the first nozzle group according to the invention and the odd-numbered rows are set as the second nozzle group according to the invention.

The invention is not limited to the embodiments described above, and various modifications can be performed on the basis of the aspects of the invention.

For example, according to the embodiment described above, an example of a configuration is described, in which the voltages Vd1 to Vd3 of the ejection drive pulses DP1 to DP3 become different and thus, the flying speeds of the inks which are ejected by these drive pulses are different from each other, but the configuration is not limited thereto. For example, it is possible to employ a configuration in which the voltages of the ejection drive pulses DP1 to DP3 are arranged to be constant, and each ejection drive pulse has a different slope for the contraction portion p3 that drives the piezoelectric element 23 so as to contract the pressure chamber 31 such that the ink is ejected from the nozzle 33 and thus the flying speeds of the inks that are ejected by these drive pulses are different from each other. Specifically, whereas the slope of the contraction portion p3 of the second ejection drive pulse DP2 is set to be gentler than the slope of the contraction portion p3 of the first ejection drive pulse DP1, the slope of the contraction portion p3 of the third ejection drive pulse DP3 may be set to be steeper.

According to the embodiment described above, a so-called longitudinal vibration type piezoelectric element 23 is illustrated as an example of the pressure generating unit, but there is no limitation thereto, and it is possible to employ a so-called flexural vibration type piezoelectric element. In this case, according to the embodiment described above, the drive pulse DP illustrated as an example becomes a waveform of which a direction of change of the potential is reversed, that is, the top and bottom thereof is inverted.

In addition, an example of the pressure generating unit is not limited to the piezoelectric element, and the invention can be applied even to a case where various pressure generating units such as a heating element that generates air bubbles inside the pressure chamber or an electrostatic actuator which changes a volume of a pressure chamber using an electrostatic force are used.

As long as an apparatus is a liquid ejecting apparatus that applies a drive pulse to the pressure generating unit, drives the pressure generating unit, and thereby ejects a liquid in a liquid flow path, the apparatus is not limited to the printer. The invention can be applied to various ink jet-type recording apparatuses such as a plotter, a facsimile apparatus, or a copy machine, or a textile printing apparatus that causes ink to land on a fabric (printing material) which is a kind of landing target, from a liquid ejecting head and performs printing.

What is claimed is:

1. A liquid ejecting apparatus that includes a liquid ejecting head which ejects a liquid from a nozzle by applying a drive waveform to a pressure generating unit and driving the pressure generating unit and that executes a liquid ejection process of ejecting the liquid on a landing target from the nozzle of the liquid ejecting head while causing the landing target of the liquid to be transported; and a control unit that controls the functions of the liquid ejecting apparatus, wherein a plurality of drive waveforms, each of which has a different timing at which to eject the liquid with respect to a reference signal that regulates a cycle of liquid ejection, is selectively applied by the control unit to the pressure generating unit according to a transporting speed of the landing target;

wherein a drive waveform is selectable by the control unit from a first drive waveform adjusted to be generated at a first ejection timing with respect to the reference signal, a second drive waveform adjusted to be generated at a second ejection timing which is earlier than the first ejection timing with respect to the reference signal, and a third drive waveform adjusted to be generated at a third ejection timing which is later than the first ejection timing with respect to the reference signal, wherein an ejection timing with respect to the reference signal during the current ejection is selected by the control unit to be different from an ejection timing with respect to the reference signal during the previous ejection.

2. The liquid ejecting apparatus according to claim 1, wherein the second drive waveform is set such that a flying speed of the liquid which is ejected is decreased compared to the case of the first drive waveform, and wherein the third drive waveform is set such that a flying speed of the liquid which is ejected is increased compared to the case of the first drive waveform.

3. The liquid ejecting apparatus according to claim 1, wherein, in a case of selecting either the second drive waveform or the third drive waveform, a drive waveform other than a previously selected waveform is selected from these drive waveforms.

4. The liquid ejecting apparatus according to claim 1, wherein the reference signal is generated according to transporting of the landing target.

5. The liquid ejecting apparatus according to claim 1, wherein the liquid ejecting head includes a first nozzle group made up of a plurality of nozzles and a second nozzle group adjacent to the first nozzle group in a transport direction of the landing target, and wherein a liquid ejecting timing of the second nozzle group is set to be different from a liquid ejecting timing of the first nozzle group.

6. A method of controlling a liquid ejecting apparatus that includes a liquid ejecting head which ejects a liquid from a nozzle by applying a drive waveform to a pressure generating unit and driving the pressure generating unit and that executes a liquid ejection process of ejecting the liquid on a landing target from the nozzle of the liquid ejecting head while causing the landing target of the liquid to be transported, the method comprising:

applying selectively a plurality of drive waveforms, each of which has a different timing at which to eject the liquid with respect to a reference signal that regulates a cycle of liquid ejection, to the pressure generating unit according to a transporting speed of the landing target;

wherein a drive waveform is selectable from a first drive waveform adjusted to be generated at a first ejection timing with respect to the reference signal, a second drive waveform adjusted to be generated at a second ejection timing which is earlier than the first ejection timing with respect to the reference signal, and a third drive waveform adjusted to be generated at a third ejection timing which is later than the first ejection timing with respect to the reference signal, wherein an ejection timing with respect to the reference signal during the current ejection is different from an ejection timing with respect to the reference signal during the previous ejection.

* * * * *